US006706970B2

(12) United States Patent
Laub et al.

(10) Patent No.: US 6,706,970 B2
(45) Date of Patent: Mar. 16, 2004

(54) STRAIN RELIEF FOR ELECTRICAL CABLE

(75) Inventors: Michael F. Laub, Harrisburg, PA (US); John P. Huss, Jr., Harrisburg, PA (US); Hurley C. Moll, Harrisburg, PA (US); Charles R. Malstrom, Lebanon, PA (US); Gregory T. Pawlikowski, Windsor, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/037,185

(22) Filed: Jan. 4, 2002

(65) Prior Publication Data

US 2003/0205405 A1 Nov. 6, 2003

(51) Int. Cl.[7] ..... H01B 7/00

(52) U.S. Cl. ..... 174/135; 174/68.1; 174/40 CC; 174/168

(58) Field of Search ..... 174/135, 40 CC, 174/168, 154, 163 R; 248/269, 689, 63, 49, 229.1

(56) References Cited

U.S. PATENT DOCUMENTS

| | | | | | |
|---|---|---|---|---|---|
| 3,826,881 | A | * | 7/1974 | Wigby | 439/422 |
| 3,860,316 | A | | 1/1975 | Hardesty | 339/91 R |
| 4,030,799 | A | * | 6/1977 | Venaleck | 439/405 |
| 4,443,050 | A | * | 4/1984 | Taylor | 439/397 |
| 4,512,619 | A | * | 4/1985 | Dechelette | 439/276 |
| 4,516,822 | A | | 5/1985 | Wolfel | 339/103 M |
| 4,618,202 | A | * | 10/1986 | Libregts et al. | 439/425 |
| 4,715,825 | A | * | 12/1987 | Mouissie et al. | 439/391 |
| 4,950,176 | A | * | 8/1990 | Cocco et al. | 439/344 |
| 4,990,102 | A | | 2/1991 | Myers | 439/452 |
| 5,164,545 | A | * | 11/1992 | Kreinberg et al. | 174/78 |
| 5,409,400 | A | | 4/1995 | Davis | 439/610 |
| 5,549,483 | A | | 8/1996 | Hotea | 439/399 |

(List continued on next page.)

FOREIGN PATENT DOCUMENTS

| | | |
|---|---|---|
| DE | 17 65 203 | 7/1971 |
| DE | 200 04 019 | 7/2001 |
| EP | 0342 828 | 11/1989 |
| EP | 0 353 539 | 2/1990 |

OTHER PUBLICATIONS

European Search Report for International Application No. PCT/US02/37983 dated Feb. 6, 2003.

*Primary Examiner*—Dean A. Reichard
*Assistant Examiner*—Jinhee J. Lee

(57) ABSTRACT

A cable strain relief is provided that includes a cable retention member and a cable support member matable with one another. The cable retention member has a retention body and at least one ribbed arm. The cable retention member also includes a cable grip configured to engage a cable. The cable support member has a support body that is configured to receive a cable along a cable retention passage therethrough. The channel in the cable support member frictionally receives and retains the arm on the cable retention member when the cable retention and support members are joined with one another. The cable grip is configured to securely engage at least a jacket of the cable to resist movement of the cable with respect to the cable support and retention members. Alternatively, different structures and positions for the cable grip may be provided. The cable grip may include a punch-out pattern of teeth in the retention body of the cable retention member. The cable grip may include one or more barbs provided on one or both ends of the retention body and bent inward to face the cable retention passage. The cable grip may include one or more grooves and ridges extending transverse to the cable retention passage to depress the outer surface of the cable, thereby affording better gripping.

20 Claims, 7 Drawing Sheets

U.S. PATENT DOCUMENTS 5,561,269 A * 10/1996 Robertson et al. ..... 174/92
5,575,681 A * 11/1996 Muzslay et al. ..... 29/860
5,622,642 A * 4/1997 Edwards et al. ..... 174/135
5,636,306 A * 6/1997 Mock et al. ..... 385/100
5,756,972 A * 5/1998 Vranicar et al. ..... 174/65 G
5,860,832 A * 1/1999 Wayt et al. ..... 439/465
5,864,090 A 1/1999 Wright ..... 174/40 CC
6,011,218 A * 1/2000 Burek et al. ..... 174/135
6,238,236 B1 5/2001 Craft, Jr. ..... 439/425
6,297,447 B1 * 10/2001 Burnett et al. ..... 174/40 CC
6,310,290 B1 * 10/2001 Gretz ..... 174/135
2001/0055921 A1 12/2001 Kuhnel
2001/0055922 A1 12/2001 Kuhnel
2002/0081888 A1 6/2002 Regnier et al.

* cited by examiner

STRAIN RELIEF FOR ELECTRICAL CABLE

BACKGROUND OF THE INVENTION

Certain embodiments of the present invention generally relate to a strain relief for maintaining a secure connection between separate structures, such as between electrical cables, coaxial cables, connectors, circuit boards and the like, with little or no compressive force.

In the past, connectors have been proposed for connecting electrical cables that carry power and/or data signals with other cables or other structures. Generally, electrical cables have a particular cross-sectional geometry such as the circular geometry of a coaxial cable formed with a central conductor (of one or more conductive wires) surrounded by insulation or a cable dielectric material. In coaxial cables, the dielectric material is surrounded by a circular, ring-shaped outer conductor, such as a cable braid (of one or more conductive wires). The outer conductor is surrounded by a jacket.

In certain applications using coaxial cables, a connector is mounted on at least one end of the coaxial cable. The connector includes contacts that are electrically secured to center and outer conductors of the coaxial cable through various contact mounting means. The contact mounting means may include, among other things, a crimp, solder, set screws and the like. The connector mounted on the coaxial cable is typically plugged into a mating connector that is housed on an electrical system. The electrical system, into which the coaxial cable is plugged, may be moved with little concern for the attached coaxial cable. During installation and throughout use, coaxial cables are repeatedly bent and pulled. The bending and pulling forces tend to cause relative motion at the electrical interface between the connector and the cable conductor(s). It is desirable to limit the bending and pulling forces induced on the electrical interface in order to prevent relative movement between the connector and the cable and to prevent relative movement at a separable interface between mating contacts.

Strain reliefs have been proposed to limit the amount of movement within, and forces experienced on, the electrical interface between the connector and the cable. For example, conventional strain reliefs have been mounted to, or formed integral with, the connector. The strain relief extends outward from the connector along the cable proximate the point at which the coaxial cable joins the connector. The strain relief includes an arc-shaped section that receives the jacket of the coaxial cable. One or both ends of the arc-shaped section include crimp beams that fold over or wrap around the coaxial cable. The crimp beams are compressed to securely grip the jacket of the coaxial cable between the crimp beams and the arc-shaped section of the strain relief.

However, these conventional strain reliefs have experienced certain drawbacks. For example, when the strain relief compresses the jacket of a coaxial cable, the strain relief deforms the shape of the coaxial cable. Coaxial cables normally have a circular cross-section with a central conductor positioned at the center of the outer conductor which has a ring-shaped circular cross-section. The circular shape of the outer conductor and the relation between the center and outer conductors is maintained by the dielectric material that separates the center and outer conductors. It is preferable to maintain the circular shape for the outer conductor in order to maintain an even radial distance between the center and outer conductors. This even radial distance, in turn, maintains symmetric electromagnetic field distribution about the coaxial cable.

The conventional strain relief deforms the shape of the outer conductor and the dielectric material from their original geometry. When the dielectric material and outer conductor are deformed from their original geometry, the electromagnetic field distribution surrounding the coaxial cable is also changed. The modified electromagnetic field distribution created by the strain relief affects the coaxial cable's impedance characteristics and may degrade signal performance. For example, the modified electromagnetic field distribution may increase the impedance exhibited by the coaxial cable and\or may affect the voltage standing wave ratio (VSWR), shield effectiveness and the like.

An improved strain relief is needed that avoids the above noted problems and other disadvantages experienced heretofore.

BRIEF SUMMARY OF THE INVENTION

In accordance with at least one embodiment, a cable strain relief is provided that comprises a cable retention member and a cable support member matable with one another to define a cable retention passage therethrough. The cable support and retention members are configured to receive a cable along the cable retention passage. The cable retention member has a retention body and at least one arm. The cable retention member also includes a cable grip configured to engage a cable. The cable support member has a support body that is secured to the arm on the cable retention member when the cable retention and support members are joined with one another. The cable grip is configured to securely engage at least a jacket of the cable to resist movement of the cable with respect to the cable support and retention members.

Alternative embodiments of the present invention include cable grips having different structures that are located in different positions. The cable grip may include a punch-out pattern of teeth centered in the retention body of the cable retention member and bent inward to face the cable retention passage. The cable grip may include one or more barbs provided on one or both ends of the retention body and bent inward to face the cable retention passage. The cable grip may include one or more grooves and ridges extending transverse to the cable retention passage to depress the outer surface of the cable in a rippled manner.

Figure 1:
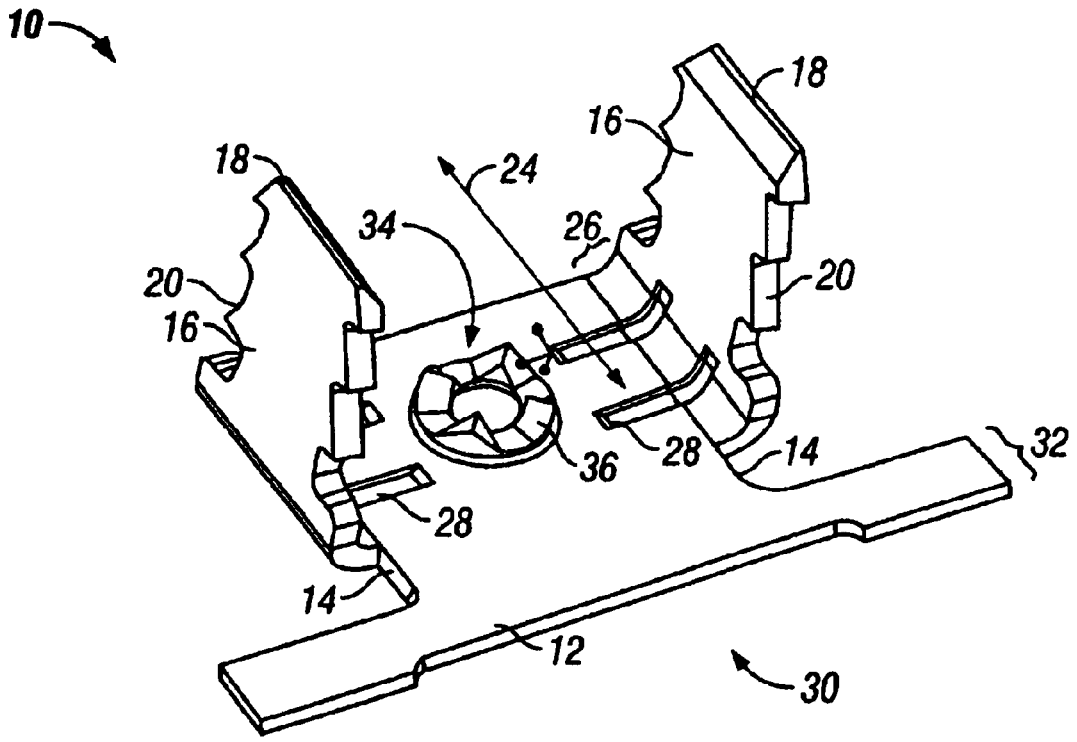
FIG. 1 illustrates an isometric view of a cable retention member formed in accordance with an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentality shown in the attached drawings.

DETAILED DESCRIPTION OF THE INVENTION

Figure 2:
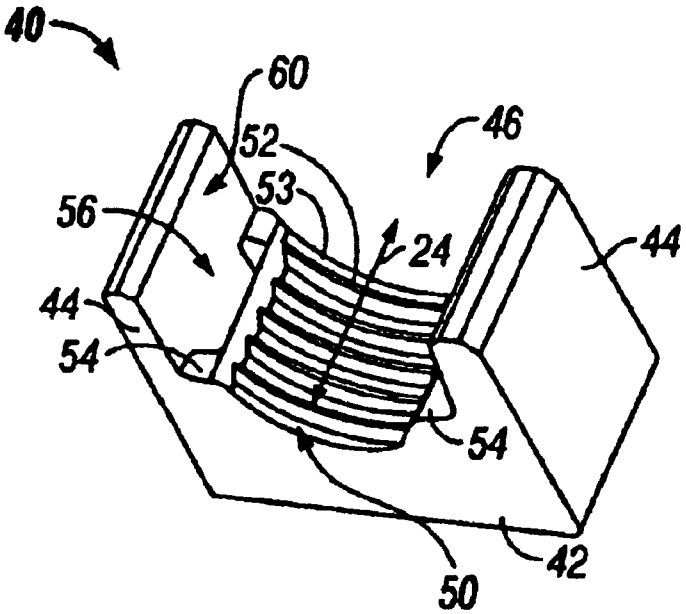
FIG. 2 illustrates an isometric view of a cable support member formed in accordance with an embodiment of the present invention.

FIG. 1 illustrates a cable retention member 10 formed in accordance with an embodiment of the present invention. The cable retention member 10 includes a cable retention body 12 having opposite sides 14 that are formed with arms 16 extending upward in a direction substantially parallel to one another and perpendicular to the cable retention body 12. The arms 16 include beveled upper edges 18. Opposite lateral edges of each arm 16 include ribs 20 projecting outward to securely engage a cable support member 40 (FIG. 2). The cable retention body 12 and arms 16 when joined with the cable support member 40 define therebetween a cable retention passage 24, in which a cable is placed and firmly held.

Rounded portions 26 are formed with opposite sides 14 and join the cable retention body 12 with the arms 16. Lateral indentations 28 are stamped into the cable retention body 12, rounded portions 26 and arms 16 to strengthen the overall structure of the cable retention member 10 and to provide a cable gripping feature that resists light stresses. In more detail, when a cable is firmly held within the cable retention passage 24, the outer surface of the cable is slightly depressed to fill the lateral indentations 28, thereby gripping the cable surface. In the embodiment of FIG. 1, lateral indentations 28 are provided on opposite sides of the cable retention body 12. A lead end 30 of the cable retention member 10 is formed integral with a separation strip 32. The separation strip 32 is initially formed with or mounted to another structure and later separated during assembly (as explained below in more detail).

The cable retention body 12 also includes a cable grip 34 centered between the arms 16. The cable grip 34 includes teeth 36 directed inward to face the cable retention passage 24. The teeth 36 pierce the jacket of the cable when the cable retention member 10 is secured to the cable. In applications in which the cable constitutes a coaxial cable, the teeth 36 may also pierce the outer conductor of the coaxial cable to afford added resistance to movement between the cable retention member 10 and the coaxial cable. The teeth 36 afford a cable gripping feature that resists heavy stresses.

FIG. 2 illustrates a cable support member 40 formed in accordance with an embodiment of the present invention. The cable support member 40 includes a cable support body 42 having opposite sides formed with sidewalls 44. The cable support body 42 and sidewalls 44 cooperate to define U-shaped notch 46 extending along the cable retention passage 24. Opposite sides of the notch 46 include ledges 54 proximate the side walls 44. The sidewalls 44 extent upward beyond the ledges 54 along opposite sides of the notch 46. Channels 56 are formed in each ledge 54 and extend through the cable support member 40 to a rear side 58 (FIG. 3) thereof. The channels 56 are spaced apart from one another to align with and receive the arms 16 of the cable retention member 10 when the cable retention member 10 and cable support member 40 are matably joined with one another to sandwich a cable therebetween. The arms 16 are inserted through the channels 56 in the direction of arrow 60 to function as a locking member that holds the cable retention and support members 10 and 40 together.

The notch 46 includes an arc-shaped inner surface 50 having transverse grooves 52. The grooves 52 are separated by a series of transversely extending ridges 53. The ridges 53 press into the outer surface of the cable, while the grooves 52 are filled by displaced surface material from the cable. The grooves 52 and ridges 53 enable the cable support member 40 to firmly engage the surface of the cable without exerting sufficient force on the cable as to deform the overall shape of the cable. In an application using a coaxial cable, the grooves 52 and ridges 53 enable the coaxial cable to be gripped adequately to resist light stresses that might otherwise cause movement between the cable support member 40 and the coaxial cable without deforming the circular ring shape of the outer conductor of the coaxial cable.

Optionally, the shape may be varied for cable retention passage 24 by changing the shape of the notch 46 in the cable support member 40 and/or the cable retention body 12 and arms 16 of the cable retention member 10 to accommodate other cable geometries. For example, the cable retention passage 24 may be rectangular, oval, triangular, square or otherwise shaped to accommodate cables having similar shapes.

Figure 3:
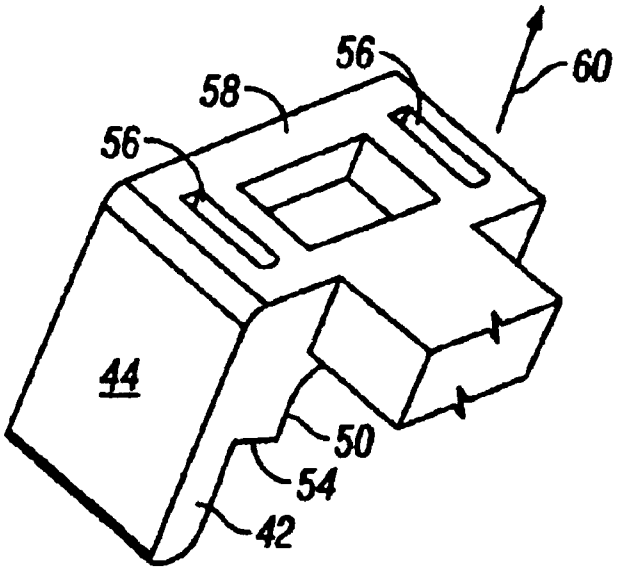
FIG. 3 illustrates a reverse isometric view of the cable support member of FIG. 2.
Figure 4:
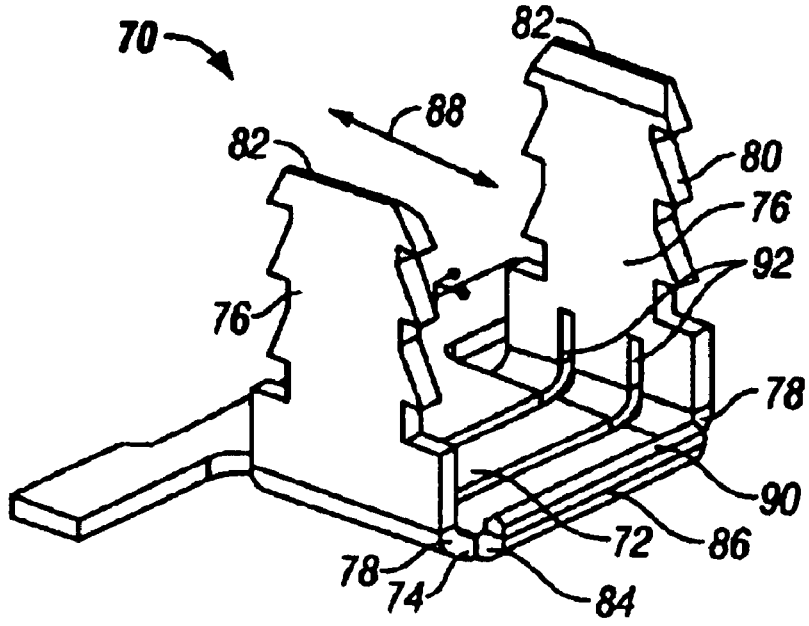
FIG. 4 illustrates an isometric view of a cable retention member formed in accordance with an alternative embodiment of the present invention.

FIG. 4 illustrates an alternative embodiment for the cable retention member. A cable retention member 70 includes a cable retention body 72 having side edges 74 formed with arms 76 at rounded portions 78. The arms 76 include ribs 80 along opposite lateral edges thereof and include beveled outer ends 82 to facilitate entry into channels 56 of the cable support member 40 (FIGS. 2 and 3). A rear end 84 of the cable retention body 72 is formed integral with a lateral beam 86 that extends in a direction transverse to a cable retention passage 88. The lateral beam 86 includes an upper edge 90 configured to securely and firmly engage the cable once located in the cable retention member 70. The cable retention body 72 further includes lateral indentations 92 that span an entire width of the cable retention body 72, rounded portions 78 and a portion of the arms 76. The lateral indentations 92 afford added support and facilitate gripping of the cable when a portion of the cable's surface is forced into the lateral indentations 92. The cable retention member 70 may be joined with the cable support member 40 (FIGS. 2 and 3) to firmly engaged a cable without deforming a normal cross-section of the cable.

Figure 5:
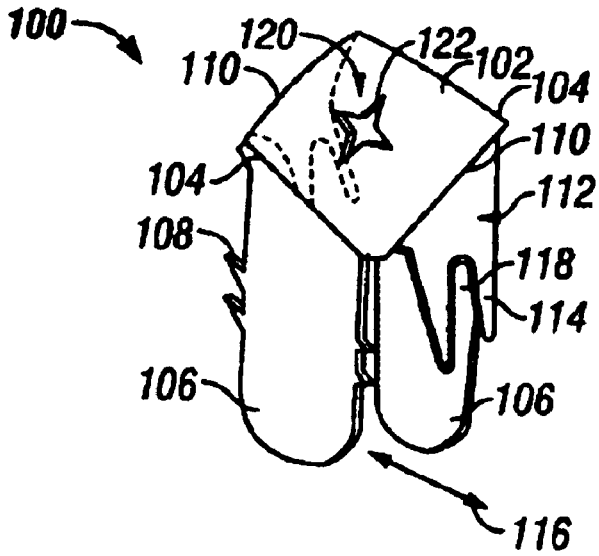
FIG. 5 illustrates an isometric view of a cable retention member formed in accordance with an alternative embodiment of the present invention.

FIG. 5 illustrates an alternative embodiment for the cable retention member. A cable retention member 100 includes a cable retention body 102 with side edges 104 joined with arms 106. The arms 106 are spaced apart with a cable retention passage 116 therebetween. The arms 106 are configured to be inserted into the channels 56 in the cable support member 40 (FIGS. 2 and 3). The arms 106 include ribs 108 on opposite lateral edges thereof to securely retain the cable retention member 100 at a desired position with respect to the cable support member 40.

Opposite ends 110 of the cable retention body 102 include forked sections 112. Each forked section 112 includes a pair of pointed prongs 114 oriented in a plane transverse to the cable retention passage 116. The prongs 114 are separated by a gap 118 having a width based on the dimensions of the cable. When used with a coaxial cable, the gap 118 may be greater than the diameter of the center conductor of the coaxial cable and smaller than the outer diameter of the dielectric material that separates the center and outer conductors. The prongs 114 cut the jacket and outer conductor of the coaxial cable and partially pierce the dielectric material separating the center and outer conductors.

The cable retention body 102 also includes a punch out 120 having a series of teeth 122 extending inward to face the cable retention passage 116. The prongs 114 and punch out 120 securely grip the cable thereby avoiding the need for the cable retention member 100 and cable support member 40 to squeeze the cable with such force as to deform the normal shape of the cable.

Optionally, any number or combination of the cable gripping features, such as the teeth 36, lateral indentations 28, grooves 52, ridges 53, lateral beam 86, lateral indentations 92, teeth 122, and prongs 114, may be used depending upon an anticipated amount of stress for a particular application.

Figure 7:
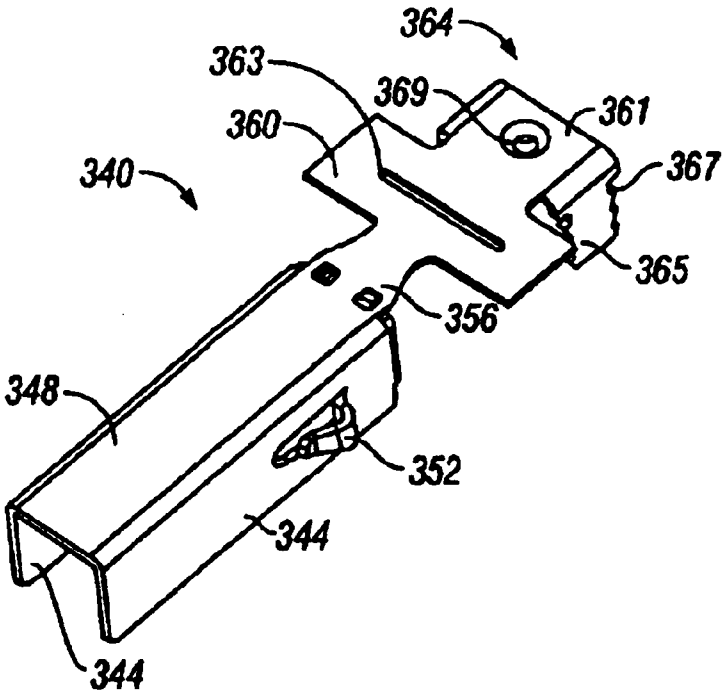
FIG. 7 illustrates a reverse isometric view of the contact shell and cable support member of FIG. 6.
Figure 6:
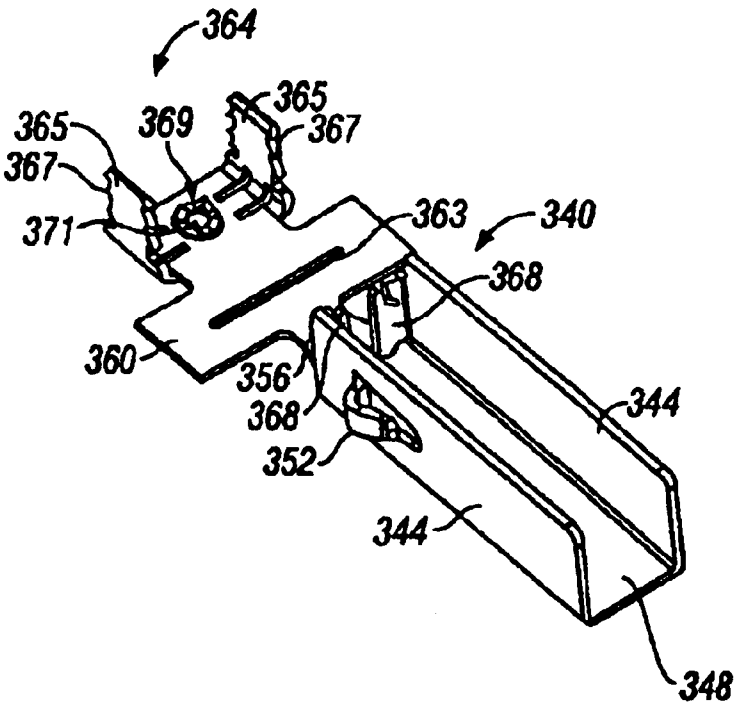
FIG. 6 illustrates an isometric view of a contact shell and cable retention member joined in accordance with one embodiment of the present invention.

FIGS. 6 and 7 illustrate opposite views of one example of a contact shell 340 that may be joined to a cable retention member. Two contact shells 340 are joined with one another when they are assembled in a connector. Each contact shell 340 includes side walls 344 and a connecting wall 348. The side walls 344 include, on one end, coaxial cable displacement contacts 368 and an open opposite end. A projection 352 is provided on at least one side wall 344 to ensure a proper electrical connection between mating contact shells 340.

The connecting walls 348 include a transition region 356 at a rear end thereof that is formed integrally with a laterally extending separation plate 360. The separation plate 360 includes a slot 363 to facilitate cutting of the separation plate 360 during assembly. The separation plate 360 may be formed integrally with the cable retention member 364. During assembly, the cable retention member 364 is physically separated from the transition region 356, such as through a stamping operation, and then secured to the coaxial cable.

The cable retention member 364 includes a cable retention body 361 joining the separation plate 360. The cable retention body 361 is secured at opposite lateral edges to arms 365 that extend parallel to one another and in a direction perpendicular to the cable retention body 361. The arms 365 include ribs 367 along both lateral edges thereof. The cable retention body 361 includes a cable grip 369 between the arms 365. The cable grip 369 includes teeth 371 directed inward to face the coaxial cable. The teeth 371 pierce the jacket of the coaxial cable and engage the outer conductor of the coaxial cable when the cable retention member 364 is secured to the coaxial cable. The cable grip 369 may be formed in a punched star pattern with a plurality of teeth 371 being stamped, and bent to face inward. Alternatively, the teeth 371 may be replaced with a single tooth. Optionally, the cable grip 369 need not engage the outer conductor, but instead may only pierce a surface of the jacket sufficiently to resist any anticipated cable stresses.

Figure 9:
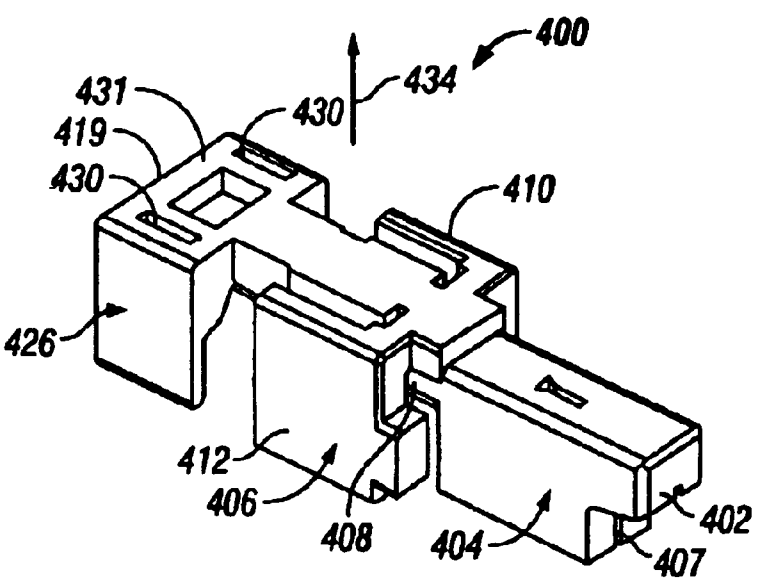
FIG. 9 illustrates a reverse isometric view of the insulated housing and cable support member of FIG. 8.
Figure 8:
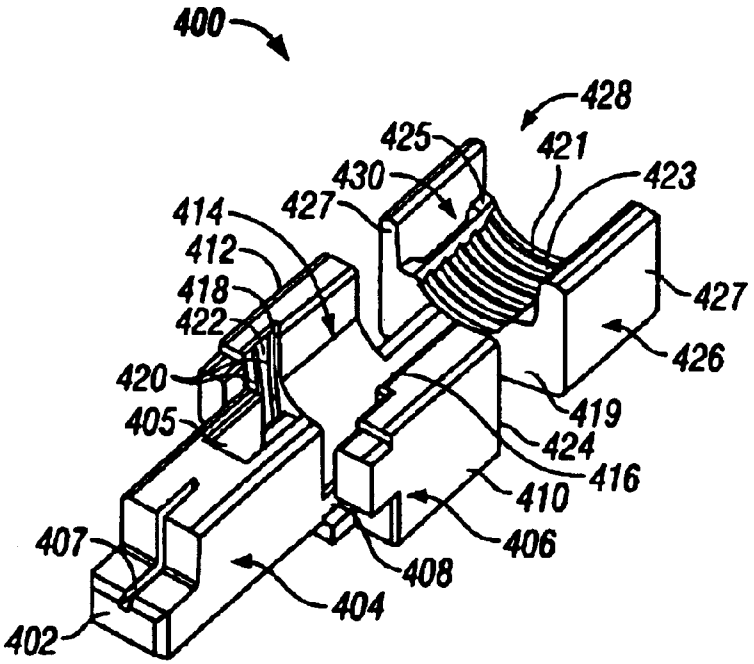
FIG. 8 illustrates an insulated housing joined with a cable support member formed in accordance with an embodiment of the present invention.

FIGS. 8 and 9 illustrate opposite views of one example of an insulated housing 400 that may be joined to a cable support member. The insulated housing 400 includes a mating face 402 on a front end of a rectangular body section 404. A rear end of the body section 404 is formed with a shroud 406 through a joining section 408. The shroud 406 includes opposed side walls 410 and 412 cooperating to define a U-shaped chamber 414 therebetween that receives the coaxial cable. Interior surfaces of the side walls 410 and 412 include notches 416 and 418 facing one another and extending vertically in a direction transverse to a length of the insulated housing 400. At least one of the notches 416 and 418 includes a pair of parallel ribs 420 that extend along the length of the corresponding notch 416 or 418.

The body section 404 includes a chamber 405 adapted to receive a leading end of the coaxial cable and a crimp on a blade or receptacle contact attached thereto. A front end of the body section 402 includes a slot 407 that accepts an associated one of the blade and receptacle contacts.

A rear end 424 of the shroud 406 is joined with a cable support member 426 having a cable support body 419 with a U-shaped notch 428 therein. The notch 428 in the cable support member 426 includes an inner surface 421 having transverse grooves 423. Opposite sides of the notch 428 form ledges 425. Side walls 427 extend upward from the ledges 425 along opposite sides of the notch 428. Channels 430 are formed in each ledge 425 and extend through the cable support member 426 to a rear side 431. The channels 430 are spaced apart to align with and receive the arms 365 when the contact shell 340 is laterally joined with insulated housing 400 in the direction of arrow 434 (FIG. 9). The length of each channel 430 is slightly less than an outer dimension of the ribs 367 such that, as the arms 365 are pressed into channels 430, the ribs 367 engage the ends of channels 430 to hold the cable retention member 364 and cable support member 426.

As the cable retention member 364 and cable support member 426 are pressed together, the teeth 371 of the cable grip 369 pierce the jacket and engages the outer conductor of the coaxial cable. The cable grip 369 secures the cable retention member 364 to the coaxial cable and prevents relative axial motion therebetween.

The cable grip 369 resists axial movement between the coaxial cable and the insulated housing 400 without deforming the circular cross-section of the coaxial cable. The cable retention member 364 and cable support member 426 minimize compression of the coaxial cable into a compressed geometry which may otherwise interfere with the impedance and signal performance. The channels 430 and arms 365 need not have a rectangular cross-section, but instead may be circular, square, arcuate, triangular and the like. Optionally, the number of channels 430 and arms 365 may be fewer or greater than two.

Figure 10:
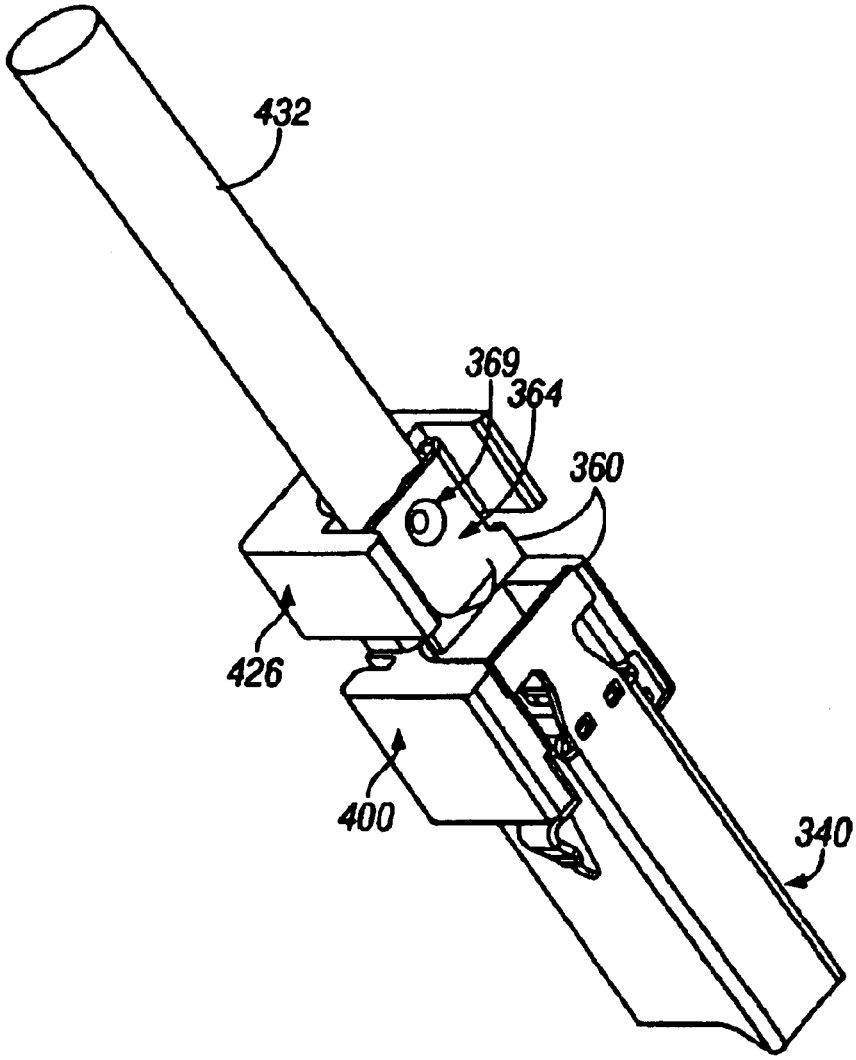
FIG. 10 illustrates a strain relief joined to a cable in accordance with an embodiment of the present invention.

FIG. 10 illustrates the contact shell 340 mated to a corresponding insulated housing 400. The cable retention member 364 is separated from the contact shell 340 at the separation plate 360. The cable retention and support members 364 and 426 are pressed toward one another until the cable grip 369 pierces the cable 432 by a desired amount to form a strain relief.

Figure 11:
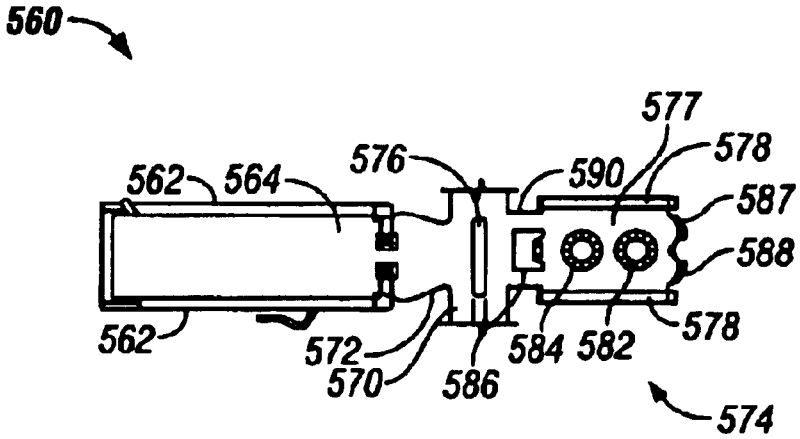
FIG. 11, illustrates a top plan view of a contact shell and cable retention member formed in accordance with an alternative embodiment of the present invention.
Figure 12:
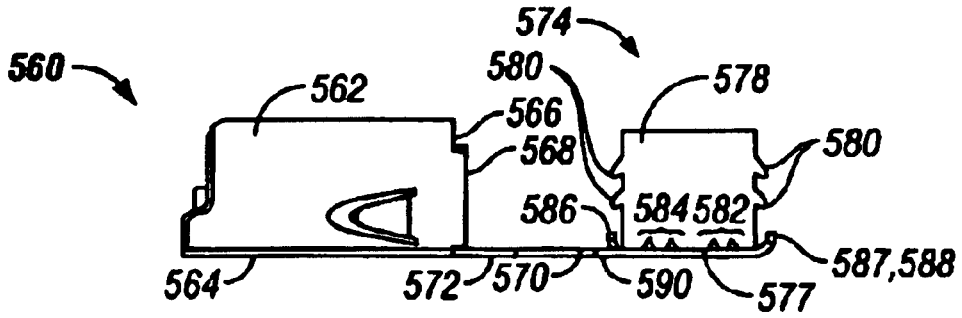
FIG. 12 illustrates a side view of the contact shell and cable retention member of FIG. 11.

FIGS. 11 and 12 illustrate an alternative embodiment for a contact shell and cable retention member. The contact shell 560 includes side walls 562 and a connecting wall 564. A contact retention end 566 of the side walls 562 includes coaxial cable displacement contacts 568. The connecting wall 564 is joined with a separation plate 570 through a transition region 572. The separation plate 570 is in turn connected to a cable retention member 574 through a transition region 590. The separation plate 570 includes a slot 576 to facilitate cutting of the separation plate 570.

The cable retention member 574 is U-shaped and includes a cable retention body 577 having arms 578 on opposite sides thereof and extending upward therefrom. The arms 578 include ribs 580 on opposite sides thereof. The cable retention member 574 operates in the same manner as the cable retention members 364 discussed above to frictionally engage channels in a mating cable support member (such as channels 430 in cable support member 426 in FIGS. 8 and 9).

The cable retention member 574 includes multiple cable gripping features, such as cable grips 582 and 584 and barbs 586–588. Cable grips 582 and 584 are provided along the length of the cable retention body 577 and are formed by punching a star pattern in the cable retention body 577 and bending the star pattern to provide a circular ring of teeth extending upward from the cable retention body 577. The barbs 586–588 are provided on opposite ends of the cable retention body 577. In the example of FIGS. 11 and 12, a barb 586 is stamped in, and bent upward proximate, the lead edge of the cable retention body 577 within the transition region 590 connecting the cable retention member 574 to the separation plate 570. A pair of barbs 587 and 588 are provided proximate the rear edge of the cable retention body 577 next to one another. The cable grips 582 and 584, and barbs 586–588 pierce the coaxial cable when the cable retention member 574 is securely joined with a corresponding cable support member 426. The cable grips 582 and 584, and barbs 586–588 may extend so far into the coaxial cable as to completely pierce the outer jacket and engage and/or also pierce the outer conductor to afford a secure connection between the cable retention member 574 and the coaxial cable.

Figure 13:
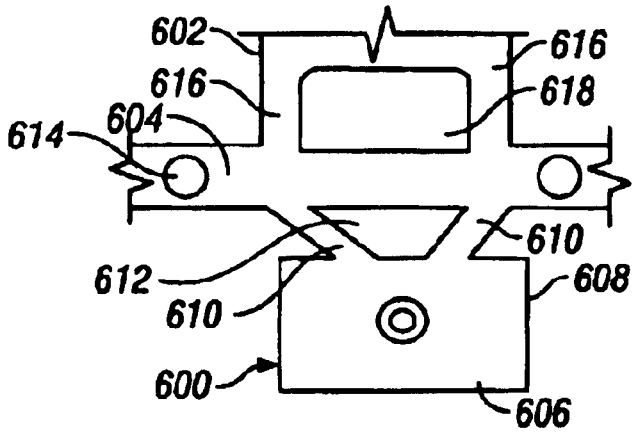
FIG. 13 illustrates a top plan view of a cable retention member and contact joined to a carrier strip.

FIG. 13 illustrates a cable retention member 600 joined with a portion of a contact shell 602 through a carrier strip 604. The cable retention member includes a cable retention body 606 having a lead edge 608 stamped integral with two linking straps 610. The linking straps 610 are also stamped integral with one side of the carrier strip 604. The linking straps 610 are separated by an opening 612.

The carrier strip 604 is stamped integrally on an opposite side to the contact shell 602 through linking straps 616. The linking straps 616 are separated by a space 618. The carrier strip 604 includes pilot holes 614 that are mated with a tool die that pulls the carrier strip 604 and cable retention member 600 along an assembly process. Once the contact shell 602 and cable retention member 600 are located proximate a corresponding insulated housing and cable support member (not shown), the linking straps 610 and 616 are cut and the cable retention member 600 is pressed into a mating cable support member (not shown).

Figure 14:
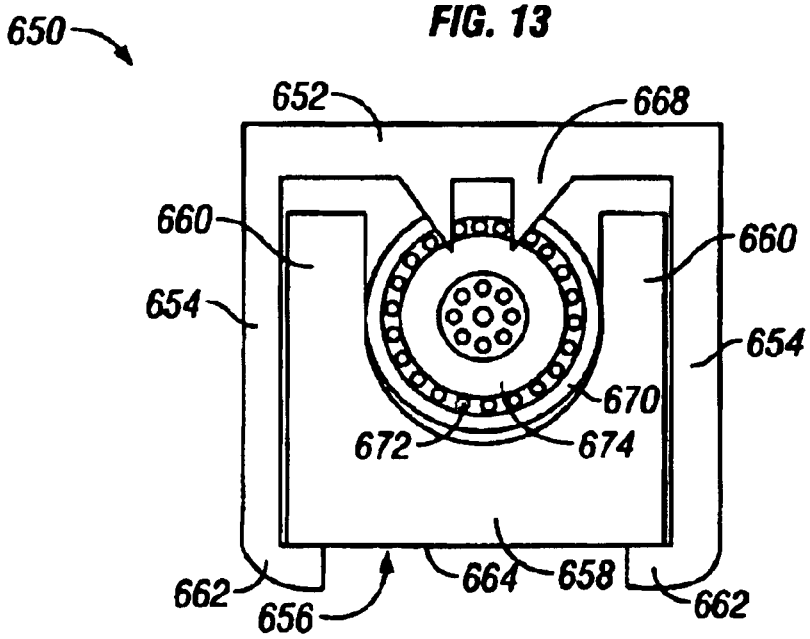
FIG. 14 illustrates an end view of cable retention and support members joined with one another in accordance with an alternative embodiment of the present invention.

FIG. 14 illustrates an alternative embodiment for the cable retention and support members. A cable retention member 650 includes a cable retention body 652 with arms 654 provided on opposite sides of the cable retention body 652. The cable retention body 652 and arms 654 enclose the cable support member 656 which includes a cable support body 658 and opposed side walls 660. The cable support body 658 does not include channels, nor do the arms 654 include ribs. Instead, the arms 654 are spaced apart sufficient to receive the side walls 660 therebetween. Outer ends 662 on the arms 654 are crimped to wrap around a back side 664 of the cable support body 656. The outer ends 662 are crimped until teeth 668 on the cable retention body 652 pierce at least one of the jacket 670 and outer conductor 672 without entirely piercing the dielectric layer 674 of a coaxial cable.

Optionally, the arms 654 and/or side walls 660 may be modified to include ridges and valleys (not shown) on an inner side of the arms 654 and on the outer side of the side walls 660. The ridges and valleys engage one another as the arms 654 are slid over the side walls 660 to secure the cable retention and support members 650 and 652 to one another. In this alternative configuration, the outer ends 662 may remain or be removed.

Optionally, the cable retention and support members may be modified to remove the arms from the cable retention body entirely and instead provide the arms on the cable support body. Similarly, the channels through the cable support body may be removed and instead provided on the cable retention body.

Optionally, the arms on the cable retention body and the side walls on the cable support body may be removed entirely. Instead, a separate locking collar may be placed entirely or partially around the cable retention and support bodies to secure them to one another.

Optionally, teeth may be provided on the cable support member in place of, or in addition to the teeth and/or other retention features on the cable retention member.

Optionally, the cable support and retention members need not be used with coaxial cable, but instead may be adapted to be connected to discrete components, a printed circuit board, a circuit board, a flex circuit, a differential pair, a twisted pair of wires, two wires, a back plane, and the like. Accordingly, the end of the cable support and retention members need not include a shell or coaxial cable displacement crimp as discussed above.

Optionally, the cable retention and support members may be used with an insulated conductor other than a coaxial cable. For instance, the insulated conductor may include one or more individual conductors surrounded with insulation. If more than one conductor (braided or single strand) exist, the conductors may be arranged side by side, in a helix, in a circular pattern and the like. The cable gripping features need not entirely pierce the insulation, but instead may only grip or partially pierce the insulation without directly contacting the conductor(s).

Optionally, the cable retention and support members need not be attached to an end of an electrical cable, but instead may be mounted at an intermediate point along the length of the electrical cable. The cable retention and support members may be attached anywhere along an electrical cable, at which it is desirable to fasten the electrical cable to another structure, such as other electrical cables, a panel, the wall or floor, a circuit board, a computer housing and the like.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications that incorporate those features which come within the spirit and scope of the invention.

What is claimed is:

1. A cable strain relief, comprising:

a cable retention member having a retention body, said cable retention member including a cable grip configured to pierce a cable;

a cable support member having a support body, said cable support member and said cable retention member joining to define a cable retention passage that is configured to receive a cable; and a locking member securing said support body to said retention body to hold said cable retention member in a fixed relation to said cable support member, said cable grip extending inward into said cable retention passage and being configured to pierce at least a first side of a cable to resist movement of a cable with respect to said cable support and retention members.

2. The cable strain relief of claim 1, wherein said support body includes a U-shaped notch extending along a length of said cable retention passage and being configured to join, without piercing, a second side of a coaxial cable and provide support as said cable grip pierces the first side of the coaxial cable.

3. The cable strain relief of claim 1, wherein said cable grip includes a plurality of teeth extending inward into said cable retention passage, said teeth being aligned, prior to piercing the cable, transverse to said cable retention passage and being configured to pierce an outer conductor of a coaxial cable.

4. The cable strain relief of claim 1, wherein said locking member includes arms located on opposite ends of said retention body and wherein said support body includes channels extending through opposite sides thereof, said channels being aligned with and securely receiving said arms, said channels and arms guiding said cable retention member and cable grip along a common linear insertion direction transverse to a length of the cable when piercing the cable.

5. The cable strain relief of claim 1, wherein said cable retention and support members sandwich a coaxial cable therebetween without deforming a circular geometry of the coaxial cable.

6. The cable strain relief of claim 1, wherein said cable grip includes at least one indentation slit in said retention body, said at least one indentation slit extending in a direction transverse to said cable retention passage.

7. The cable strain relief of claim 1, wherein at least one of said retention and support bodies includes at least one ridge aligned in a direction perpendicular to said cable retention passage and projecting inward along a plane dissecting said cable retention passage.

8. The cable strain relief of claim 1, wherein said support body and locking member include at least one channel and at least one arm, respectively, said at least one channel and arm slidably engaging one another and being slidable perpendicular to a cross-sectional plane of said cable retention passage, said at least one channel and arm cooperating to guide said cable grip along said insertion direction.

9. The cable strain relief of claim 1, wherein support body and said locking member include a pair of channels and a pair of ribbed arms, respectively, extending parallel to one another, said pairs of channels and ribbed arms being spaced apart by a distance sufficient to receive a cable therebetween.

10. The cable strain relief of claim 1, wherein at least one of said retention and support bodies include indentations and ridges traversing said cable retention passage, said indentations and ridges being configured respectively to accept and depress a surface of a cable held in said cable retention and support members in a rippled manner without deforming a normal shape of the cable.

11. The cable strain relief of claim 1, wherein said support body includes at least one channel therein and said retention body includes at least one arm includes ribs on opposite edges thereof forming an interference fit with said at least one channel when said retention and support bodies are joined.

12. A cable strain relief, comprising:

a cable retention member having a retention body, said cable retention member including a cable grip configured to engage a cable, wherein said cable grip includes a star-shaped pattern of teeth punched in said retention body of said cable retention member;

a cable support member having a support body, said cable support member and said cable retention member joining to define a cable retention passage that is configured to receive a cable; and a locking member securing said support body to said retention body to hold said cable retention member in a fixed relation to said cable support members, said cable grip extending inward into said cable retention passage and being configured to securely engage at least a surface of a cable to resist movement of a cable with respect to said cable support and retention members.

13. A strain relief for a coaxial cable connector, comprising:

a cable retention body including a cable grip extending inward from said cable retention body and being configured to pierce at least one side of a coaxial cable; and a cable support body configured to support without piercing a second side of a coaxial cable, said cable grip being configured to pierce a jacket of a coaxial cable to resist movement between a coaxial cable and said cable retention body when said cable retention body and strain relief member are joined.

14. The strain relief of claim 13, wherein said cable support body includes a U-shaped notch extending along a length of said cable retention passage, said U-shaped notch being configured to support without piercing one side of the coaxial cable to provide support as said cable grip pierces an opposite side of the coaxial cable.

15. The strain relief of claim 13, wherein said cable grip includes a plurality of fixed teeth extending inward to face said cable support body and being configured to engage an outer conductor of the coaxial cable.

16. The strain relief of claim 13, wherein one of said cable support body and cable retention body includes ribbed arms located on opposite sides thereof.

17. The strain relief of claim 13, wherein said cable retention and support bodies sandwich the coaxial cable therebetween without deforming a circular geometry of the coaxial cable.

18. The strain relief of claim 13, wherein said cable grip includes a forked section with a pair of fixed prongs extending from said cable retention body toward said cable support body, said pair of fixed prongs piercing the coaxial cable along a linear insertion direction transverse to a length of the coaxial cable.

19. The strain relief of claim 13, further comprising a locking member securing said cable retention body to said cable support body, said locking member including a channel and arm provided in said cable retention and support bodies, respectively, said arm being slidably received in said channel to define a linear insertion direction along which said cable grip is moved to pierce the coaxial cable.

20. The strain relief of claim 13, wherein one of said cable support and retention bodies includes an arm and another of said cable retention and support bodies includes a channel therethrough, said arm being secured in said channel.

* * * * *